US005704714A

United States Patent [19]

Stary

[11] Patent Number: 5,704,714

[45] Date of Patent: Jan. 6, 1998

[54] FLEXIBLE TUBULAR BAG FOR HYGIENIC ARTICLES AND METHOD FOR PRODUCING SAME

[75] Inventor: Christof Stary, Eckental, Germany

[73] Assignee: The Procter & Gamble Company, Cincinnati, Ohio

[21] Appl. No.: 553,575

[22] PCT Filed: May 18, 1994

[86] PCT No.: PCT/EP94/01602

§ 371 Date: Nov. 27, 1995

§ 102(e) Date: Nov. 27, 1995

[87] PCT Pub. No.: WO94/27889

PCT Pub. Date: Dec. 8, 1994

[30] Foreign Application Priority Data

May 27, 1993 [DE] Germany ..... 43 17 611.9

[51] Int. Cl.[6] ..... B65D 33/18

[52] U.S. Cl. ..... 383/67; 383/84

[58] Field of Search ..... 383/66, 67, 78, 383/81, 84, 86, 120; 206/494; 229/87.05

[56] References Cited

U.S. PATENT DOCUMENTS

| | | | |
|---|---|---|---|
| 3,227,359 | 1/1966 | Hanlon | 383/67 X |
| 4,260,061 | 4/1981 | Jacobs | 229/62 X |
| 4,786,190 | 11/1988 | Van Erden et al. | 383/66 X |
| 5,333,735 | 8/1994 | Focke et al. | 206/494 |

FOREIGN PATENT DOCUMENTS

| | | | |
|---|---|---|---|
| 0410937 | 7/1990 | European Pat. Off. | 206/494 |
| 2143819 | 4/1973 | Germany | 383/121 |
| 3933572 | 4/1991 | Germany | 206/494 |
| 4214649 | 11/1993 | Germany | 383/120 |
| 6171653 | 6/1994 | Japan | 383/120 |

*Primary Examiner*—Jes F. Pascua

*Attorney, Agent, or Firm*—Laff, Whitesel, Conte & Saret, Ltd.

[57] ABSTRACT

A flexible tubular bag for hygienic articles has a sidewall (2) which forms a cylindrical bag and a front wall (bottom wall 11) provided with an outlet (21). The walls (sidewall 2, bottom wall 11) are formed of a single foil web (23). A covering flap (14) set on the sidewall (2) and/or front wall (bottom wall 11) so as to form a single piece therewith covers the outlet (21). The surface of the covering flap (14) may be detachably joined to the flexible tubular bag.

5 Claims, 2 Drawing Sheets

FIG. 3A
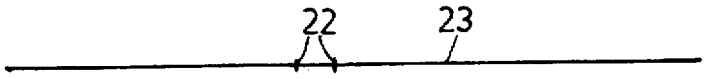
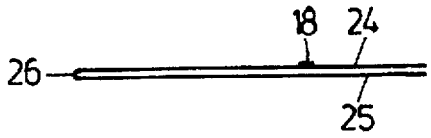
FIG. 3B
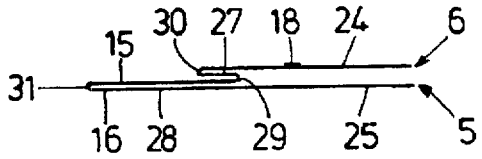
FIG. 3C
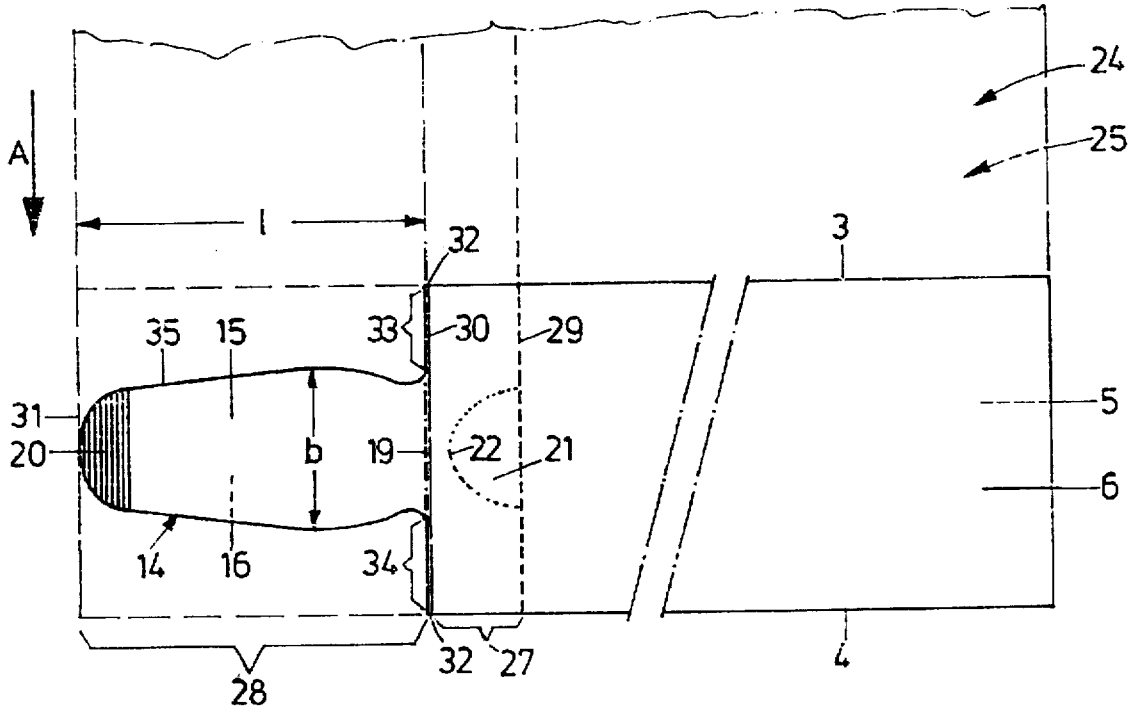
FIG. 4

FLEXIBLE TUBULAR BAG FOR HYGIENIC ARTICLES AND METHOD FOR PRODUCING SAME

BACKGROUND OF THE INVENTION

1. Field of the Invention

The invention relates to a flexible tubular bag for hygienic articles, in particular a pile of cotton pads, comprising a sidewall which forms a cylindrical bag and a front wall provided with an outlet, the walls being formed of a single foil web, as well as to a method for producing the flexible tubular bag from a continuously unwound foil web.

2. Background Art

Flexible tubular bags of the generic type involve the problem that the hygienic articles may leave the outlet inadvertently, because as a rule the outlet is disposed on the front wall that forms the bottom of the flexible tubular bag. The reason for this resides in that a suspension means in the form of a string is provided at the upper end of the flexible tubular bag so that the bag can be hung up as a sort of a dispenser and the cotton pads it contains can be removed successively from the outlet at the bottom.

A fundamental problem resides in that the contents of the bag may gradually become soiled by impurities or dust entering through the outlet.

SUMMARY OF THE INVENTION

Proceeding from the drawbacks of prior art flexible tubular bags, it is the object of the invention to further develop a flexible tubular bag of the species in such a way that reliable protection of the contents from soiling is ensured. Simultaneously, this further development aims at not substantially increasing the manufacturing requirements, because flexible tubular bags are typical mass goods.

This object is attained in that a covering flap set on the sidewall and/or the front wall is provided for covering the outlet, the surface of which covering flap may be detachably joined to the flexible tubular bag. As regards the method of production, this object is attained by the steps of doubling the foil web for two foil layers to form, one lying on top of the other, which are united, on the side of the rim, by a doubled edge extending in the direction of unwinding; asymmetrically folding the foil layer arrangement from the doubled edge of the two foil layers, which results in the forming of a short front wall fold directed inwardly and a prolonged flap fold extending between the latter and the foil layer; and welding and separating the foil layer arrangement, thus forming the sidewall out of the two foil layers, the front wall out of the front wall fold, and the covering flap out of the flap fold. Accordingly, the flexible tubular bag comprises a flap for covering the outlet, this covering flap being set on the sidewall and/or front wall of the bag so as to form a single piece therewith. For securing the covering flap in its position of covering, the surface of the flap may be detachably joined to the tubular bag for instance by means of an adhesive zone or a sticker adhesive on both sides, which may be applied on the flap or on the bag in the form of a pressure-sensitive adhesive that is sprayed on.

Because of this covering flap, the outlet can be dosed again at any time, soiling of the hygienic articles by the intrusion of dust, moisture or the like into the interior of the bag being avoided as well as any inadvertent removal of articles.

Due to the fact that the covering flap forms a single piece with the flexible tubular bag, the bag is very easy to manufacture because no separate foil blank for the covering flap must be attached.

Further features, details and advantages of the invention will become apparent from the ensuing description of an exemplary embodiment, taken in conjunction with the drawing.

BRIEF DESCRIPTION OF THE DRAWING

FIG. 4 is a plan view of a flexible tubular bag lying flatwise, as it can be obtained by welding and cutting from the foil web according to FIG. 3C.

DESCRIPTION OF THE PREFERRED EMBODIMENT

Figure 1:
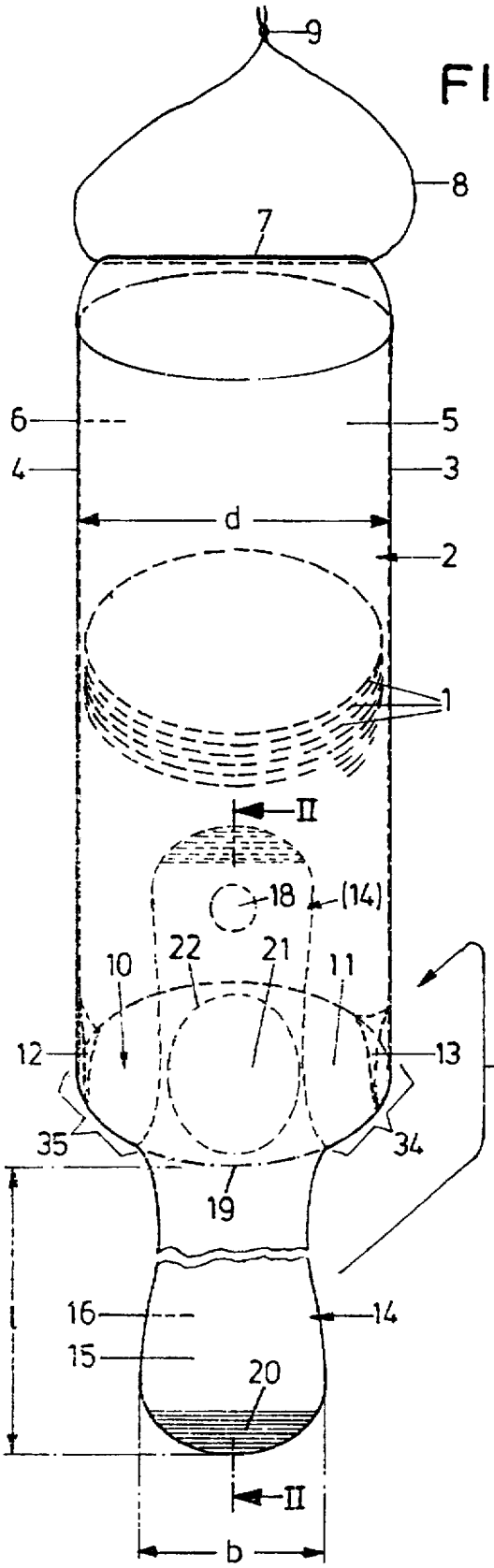
FIG. 1 is a perspective view of a flexible tubular bag according to the invention.
Figure 2:
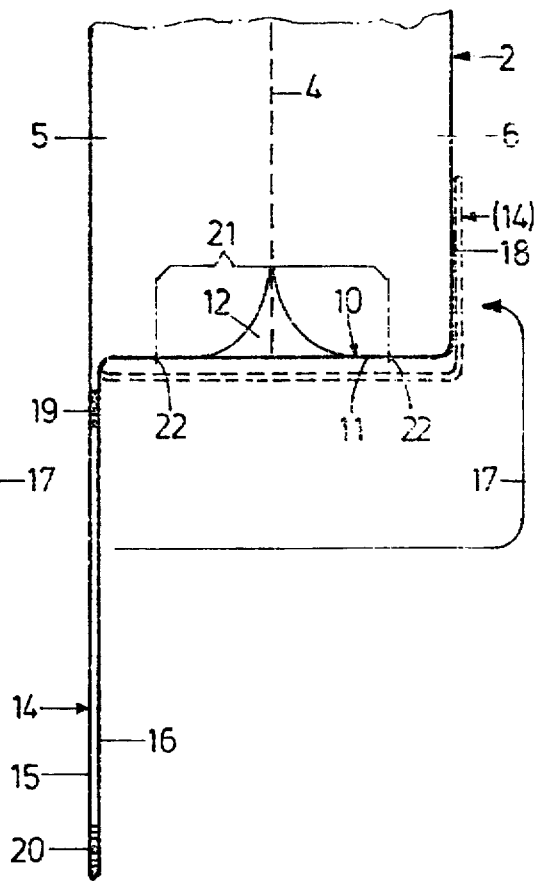
FIG. 2 is a section through the flexible tubular bag on the line II—II of FIG. 1, FIGS. 3A–C are sections through a foil web at right angles to the direction of unwinding in a sequence of intermediate stages during the production of the flexible tubular bag.

As seen in FIGS. 1 and 2, a flexible tubular bag according to the invention serves to accommodate a pile of circular cotton pads 1. The flexible tubular bag has a sidewall 2, which forms a cylindrical bag and which is composed of two sidewall members 5, 6 united by welds 3, 4. At the upper end, the sidewall members 5, 6 are joined to each other by a transverse weld 7, a suspension string 8 being run through the sidewall members 5, 6 below this weld 7 and knotted at its ends (knot 9).

On the bottom 10 of the flexible tubular bag, the two sidewalls 5, 6 integrally verge into a bottom wall 11 disposed on the face, which is welded on in the vicinity of the two welds 3, 4, thus forming the two lateral gussets 12, 13.

Centrally between the two welds 3, 4, provision is made for a covering flap 14, which comprises two foil layers 15, 16 one lying congruently on top of the other. The latter form a single piece with the sidewall member 5 on the one hand and with the bottom wall 11 on the other. The width b of this covering flap 14 corresponds to about half the diameter d of the flexible tubular bag. Its length 1 corresponds to about one and a half times the diameter d so that the covering flap 14 can be passed along the bottom 10 of the flexible tubular bag and on to the opposite sidewall member 6 corresponding to the arrow 17, where it may be detachably joined to the flexible tubular bag by means of a pressure-sensitive adhesive zone 18 applied by spraying.

Instead of the adhesive zone 18 applied by spraying, a sticker 18' adhesive on both sides can be used, which is applied as a so-called transfer sticker before the free end of the covering flap 14 during the production of the bag. The adhesiveness, to be obtained, of the adhesive layers on either side of the sticker 18' are such that the adhesiveness of the layer on the side of the covering flap is approximately one fifth of the adhesiveness of the layer on the other side. Consequently, when the covering flap is detached for opening after it has been passed on to the opposite sidewall member 6 in accordance with the arrow 17 and the sticker 18' has been pressed on this sidewall member 6, the sticker 18' will come off the covering flap 14 and stick on the sidewall member 6, where it serves for repeatedly fixing the covering flap 14 when it is closed.

In the vicinity of where the covering flap 14 is set on the flexible tubular bag, the two foil layers 15, 16 are united by a weld 19 (shown by a dash-dotted line in FIG. 1) so that the space between the two layers of foil 15, 16 is not accessible to lints, dust or the like.

The free end of the covering flap 14 is provided with a stamped reinforcement, forming a handle surface for the covering flap 14 to be seized.

The covering flap 14 serves to cover the outlet 21 which can be produced in that the portion of the bottom wall 11 defined by the perforated oval 22 is removed. For the automatic removal of the portion defined by the perforated oval 22 whenever the covering flap 14 is opened for the first time counter to the direction of the arrow 17, another sticker 18" adhesive on both sides is located in the center of this portion; adhesive layers on either side of the sticker 18" exhibit the same adhesiveness. So, a tight union is produced between the bottom wall portion defined by the perforated oval 22 and the covering flap 14, which results in the outlet 21 being torn open automatically as mentioned above. So as to aid in the controlled tearing of the perforated oval 22, the latter has a continuous slit 22' of a length of approximately 1 to 2 cm, which is disposed on the side turned away from where the covering flap 14 is set on the bag. When the covering flap 14 is torn off for the first time, the tear-off operation starts from the ends of the slit along the perforation 22. The slit 22' also contributes to deairing the bag when the cotton pads 1 are filled in, during which job the slit opens and the air can escape. This outlet to be torn open only by the consumer also provides for a tamperproof closure.

The method according to the invention for producing the flexible tubular bag will be explained on the basis of FIGS. 3 and 4.

A foil web 23, which may be printed if required, is unwound continuously from a parent reel (not shown) (FIG. 3A). During this operation, a perforated oval 22 is applied where appropriate, providing for a tear-off outlet 21.

Subsequently, the foil web 23 is doubled from one side, forming two foil layers 24, 25 one lying on top of the other. Owing to the fact that the web is doubled from one side, the two foil layers 24, 25 are united, on the side of their rim, by a doubled edge 26 extending in the direction of unwinding A (FIG. 3B). An adhesive zone 18 of a pressure-sensitive adhesive is sprayed on the upper foil layer 24 where appropriate. Then this foil layer arrangement is folded asymmetrically from the doubled edge 26, which results in the forming of a short bottom wall fold 27 directed inwardly and a prolonged flap fold 28 that extends between the the fold 27 and the lower foil layer 25 (FIG. 3C). The bottom wall fold 27 has an inner folded edge 29 running parallel to the direction of unwinding A. The upper foil layer 24 is defined by a folded edge 30 likewise running in the direction of unwinding A. The rim of the flap fold 28 has a folded edge 31, the flap fold 28 forming the foil layers 15, 16 mentioned above of the covering flap 14.

Once the foil layer 23 is arranged in the configuration seen in FIG. 3C, the flexible tubular bag, which is shown lying flatwise in FIG. 4, is produced from the foil layer arrangement according to FIG. 3C by a suitable welding and separating tool. This welding and separating tool welds and separates the two foils layers 24, 25 of the foil web 23, forming the straight welds 3, 4, which extend at right angles to the direction of unwinding A and which unite the two sidewall members 5, 6 formed from the foil layers 24, 25. The welds 3, 4 extend as far as slightly beyond the folded edge 30 between the upper foil layer 24 and the bottom wall fold 27, the bottom wall fold 27 being seized thereby in the vicinity of the two welds 3, 4, which results in the two gussets 12, 13 being formed. At the end 32, on the side of the bottom, of the welds 3, 4, the welding and separating tool continues in such a way as to form the weld portions 33, 34 extending in the direction of unwinding A and a weld portion 35 a connecting the latter and defining the contour of the covering flap 14.

Coinciding with the welding and separating operation by the welding and separating tool (not shown in detail), the weld 19 is provided between the two ends, facing each other, of the weld portions 33, 34, uniting the two foil layers 15, 16 of the covering flap 14.

For a short distance, the weld portions 33, 34 and the weld 19 are located laterally beside the folded edge 30 so that the welding tool can act without any problem. Attention is, however, drawn to the fact that by the vertical installation of the folded edge 30, the weld 19 and the two weld portions 33, 34 can be provided in alignment with this folded edge 30.

I claim:

1. A flexible tubular bag for hygienic articles comprising a sidewall (2) which forms a cylindrical bag and a front wall (11) provided with an outlet (21), said sidewall (2) and front wall (11) being formed of a single foil web (23), wherein a covering flap (14) is provided for covering the front wall with the outlet (21), the surface of which covering flap (14) being detachably joined to the flexible tubular bag, and the covering flap (14) has two foil layers (15, 16), which are each integrally attached to the sidewall (6) and front wall (11), respectively, so as to form a single piece therewith.

2. A flexible tubular bag according to claim 1 wherein the covering flap (14), (on the sidewall (2) and front wall (11)), (is provided with a seam (19) uniting the two foil layers (15, 16)).

3. A flexible tubular bag according to claim 1, wherein said covering flap (14) has a width (b) of approximately half a diameter (d) of the flexible tubular bag and a length (1) of the covering flap (14) exceeds said diameter (d).

4. A flexible tubular bag according to claim 1, wherein a free end of the covering flap (14) is provided with a handling surface (20).

5. A flexible tubular bag according to claim 1, wherein a free end of the covering flap (14) is detachable fixed, by means of an adhesive zone (18), on a portion of the sidewall (2) which is opposite to where the covering flap (14) is attached to the bag.

* * * * *